US005087803A

United States Patent [19]

Kurtz

[11] Patent Number: 5,087,803

[45] Date of Patent: Feb. 11, 1992

[54] ELECTRICAL SWITCH FOR HAZARDOUS ENVIRONMENTS

[75] Inventor: Michael A. Kurtz, Belleville, Ill.

[73] Assignee: Hubbell Incorporated, Orange, Conn.

[21] Appl. No.: 526,716

[22] Filed: May 22, 1990

[51] Int. Cl.[5] ..... H01H 13/52; H01H 9/04

[52] U.S. Cl. ..... 200/526; 200/302.2; 200/527

[58] Field of Search ..... 200/16 R, 16 A, 520, 200/523, 525, 526, 527, 529, 530, 531, 535, 536, 537, 360.1-360.3, 341, 345

[56] References Cited

U.S. PATENT DOCUMENTS

| | | | |
|---|---|---|---|
| 1,342,229 | 6/1920 | Roos | 200/527 |
| 1,347,308 | 7/1920 | Thomas | 200/527 |
| 1,387,419 | 8/1921 | Loeffler | 200/527 |
| 1,907,688 | 5/1933 | Von Henke | 200/302.2 |
| 1,950,716 | 3/1934 | Douglas | 200/536 |
| 2,195,237 | 3/1940 | Bryant et al. | 200/536 |
| 2,798,907 | 7/1957 | Schneider | 200/527 |
| 3,038,054 | 6/1962 | Naimer | 200/302.1 |
| 3,093,715 | 6/1963 | Kaneko | 200/302.2 |
| 3,204,067 | 8/1965 | Brown | 200/527 |
| 3,521,015 | 7/1970 | Wooldridge et al. | 200/345 |
| 3,586,810 | 6/1971 | Brown | 200/520 |
| 3,646,297 | 2/1972 | Anthony | 200/528 |
| 3,778,577 | 12/1973 | Fromknecht et al. | 200/302.3 |
| 4,029,914 | 6/1977 | Schmidt et al. | 200/1 R |
| 4,208,558 | 6/1980 | Alsch | 200/302.1 |
| 4,218,601 | 8/1980 | Saito | 200/345 |
| 4,315,123 | 2/1982 | Fujita et al. | 200/307 |
| 4,324,956 | 4/1982 | Sakakino et al. | 200/302.1 |
| 4,476,359 | 10/1984 | Bienwald | 200/536 |
| 4,568,807 | 2/1986 | Piper | 200/302.2 |
| 4,803,313 | 2/1989 | Rolf | 200/302.1 |

*Primary Examiner*—J. R. Scott

*Attorney, Agent, or Firm*—Jerry M. Presson; Mark S. Bicks; Alfred N. Goodman

[57] ABSTRACT

An electrical switch for hazardous environments includes a non-metallic terminal base supporting a plurality of stationary contacts. A non-metallic operator body has a radial wall and tubular outer wall extending from the radial wall. The outer wall has a free end coupled to the terminal base and defines a contact chamber inside of the operator body. The radial wall has a central passageway and a tubular inner wall extending from the radial wall toward the terminal base substantially concentrically to the outer wall and the passageway. A non-metallic operator member has an annular portion slidably received in the passageway between first and second positions, and has a radial portion extending from the axial portion with a tubular flange extending from it substantially concentrically to the axial portion. The operator member tubular flange is slidably received between and overlaps the inner and outer walls of the operator body in both of the first and second positions of the operator body. An operator is coupled to the operator member for movement between open and closed positions in response to movement of the operator member between its first and second positions. Movable contacts are mounted on the operator for simultaneous movement with the operator between positions engaging and disengaging the stationary contacts on the terminal base.

19 Claims, 3 Drawing Sheets

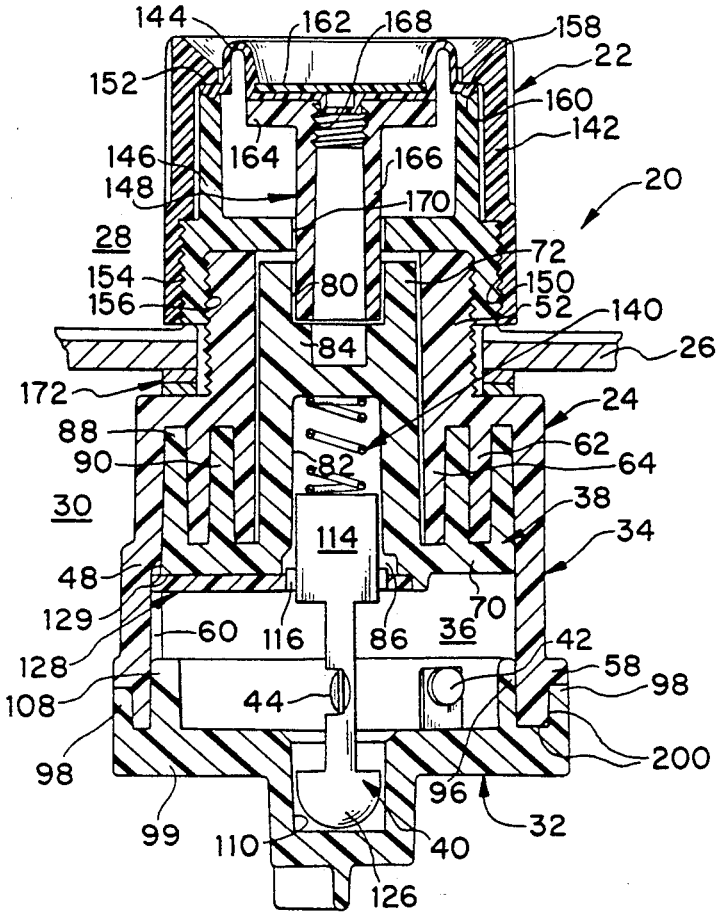
FIG. 1
FIG. 4
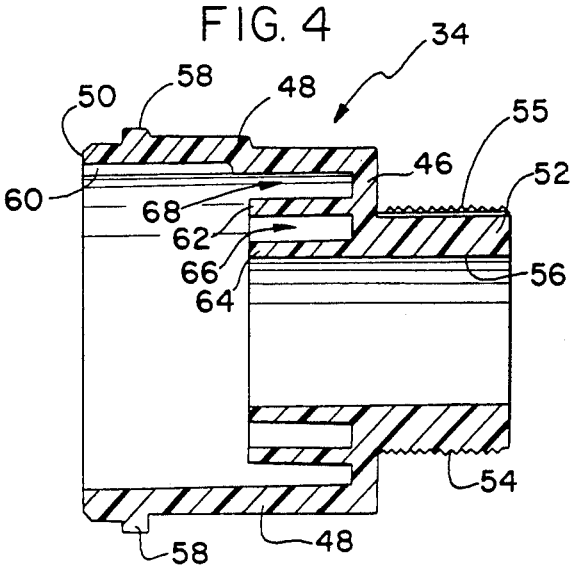
FIG. 3
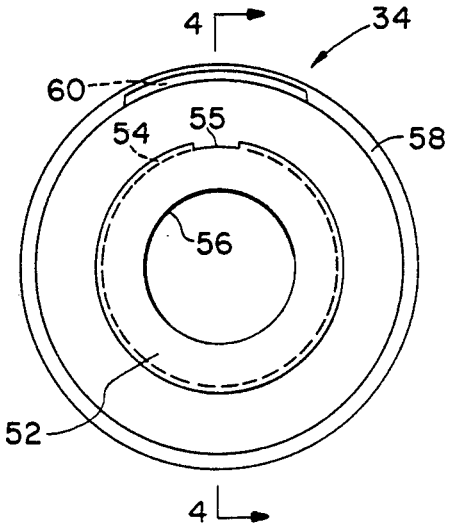

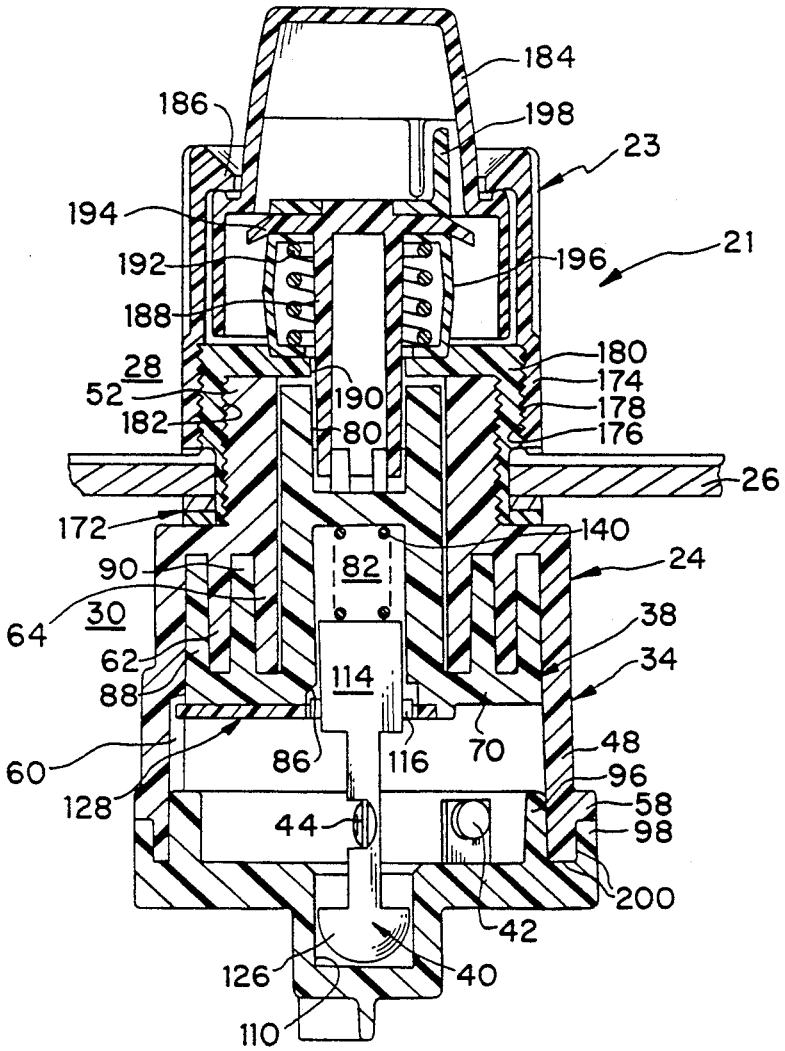
FIG. 2
FIG. 5
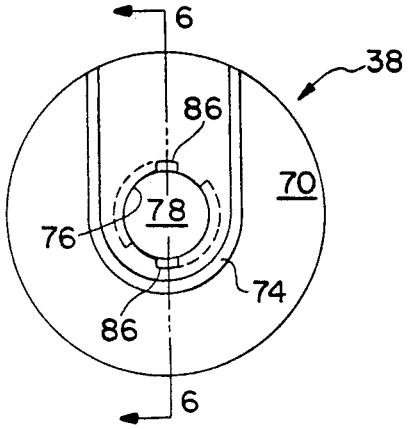
FIG. 6
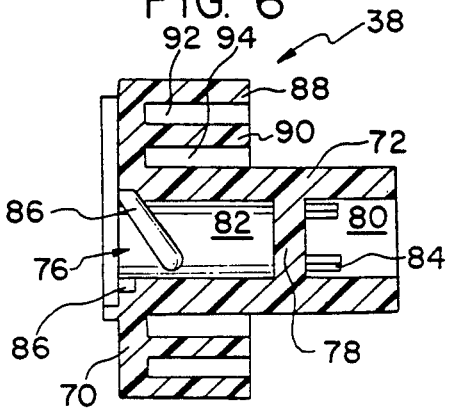

ELECTRICAL SWITCH FOR HAZARDOUS ENVIRONMENTS

FIELD OF THE INVENTION

The present invention relates to an electrical switch made extensively from non-metallic parts which is particularly useful in explosive and other hazardous atmospheres. The switch has a contact chamber with a flame proof joint toward the hazardous atmosphere which will contain ignited gases and vapors in the contact chamber and prevent ignited gases and vapors from igniting the external hazardous atmosphere. The flame proof joint includes moving and fixed parts which mate to form a labyrinth.

BACKGROUND OF THE INVENTION

In hazardous environments, particularly those involving explosive gases or vapors, the electrical switches must be designed to inhibit or prevent ignition of the explosive gases or vapors. Additionally, the switches must be readily accessible for operation within the hazardous environment or exposed to the combustible or explosive gases or vapors.

The switch must have relatively movable parts which must be able move in an easy manner between on and off positions. With these easily movable parts, it is extremely difficult to prevent the entry of the explosive gases or vapors into the switch chamber housing the movable and stationary contacts which make and break the electrical circuit to which they are attached.

During engagement and disengagement of the stationary movable contacts within the contact chamber of the switch, sparks are often generated. The sparks will tend to ignite the explosive or combustible gases which may have seeped into the contact chamber between the relatively movable parts of the switch. The ignition of the gases and vapors within the relatively small contact chamber of the switch can be tolerated. However, the flame or ignited gases and vapors cannot be permitted to escape the switch contact chamber and engage the explosive gases and vapors located exterior to the switch to which the switch is exposed. If the ignited gases or vapors within the contact chamber are permitted to escape, such ignited gases and vapors could ignite the exterior explosive gases or vapors causing a serious explosion.

SUMMARY OF THE INVENTION

An object of the present invention is to provide an electrical switch with a flame proof joint which can separate a switch chamber housing the movable and stationary contacts from the exterior hazardous atmosphere.

Another object of the present invention is to provide an electrical switch made extensively from non-metallic parts which can be used in explosive and other hazardous environments.

A further object of the present invention is to provide an electrical switch which is simple and inexpensive to manufacture and is of rugged construction.

The foregoing objects are obtained by an electrical switch having a non-metallic terminal base, a non-metallic operator body, a non-metallic operator member and operator means coupled to the operator member. The terminal base supports a plurality of stationary electrical contacts. The operator body has a radial wall and a tubular outer wall extending from the radial wall.

The outer wall has a free end coupled to the terminal base and defines a contact chamber therein. The radial wall has a central passageway and a tubular annular wall extending from the radial wall toward the terminal base substantially concentrically to the outer wall and the passageway. The operator member has a axial portion slidably received in the passageway for movement between first and second positions and has a radial portion extending from the axial portion with a tubular flange extending therefrom substantially concentrically to the axial portion. The tubular flange is slidably received between and overlaps the inner and outer walls of the operator body in both of the first and second positions of the operator body. The operator means moves between open and closed positions in response to the movement of the operator member between its first and second positions. The movable contacts are mounted on the operator means for simultaneous movement therewith between positions engaging and disengaging the stationary contacts on the terminal base.

By forming the electrical switch in this manner, the switch only has a minimum number of metal parts to minimize sparks. All metal parts (i.e. the contacts and a spring) are retained within the contact chamber of the switch.

The engagement of the operator member tubular flange with the inner and outer walls of the operator body provides a labyrinth or restricted path which will inhibit propagation of any ignition occurring in the contact chamber. Although explosive gases and vapors may seep into the contact chamber and may be ignited in the contact chamber, any flame produced cannot escape from the contact chamber. The overlap or engagement of the tubular flange with the operator body inner and outer walls, in all positions of the switch, would extinguish any flame generated within the contact chamber. Such flame would be extinguished in each and every position of the switch. Since the flame would be extinguished in the labyrinth formed by the tubular flange and inner and outer walls, the flame and ignition cannot propagate into the surrounding atmosphere of the switch.

The flame proof joint forming the labyrinth can be easily formed by standard molding techniques with standard molding tolerances. This facilitates the manufacture of the switch of the present invention.

Other objects, advantages and salient features of the present invention will be come apparent from the following detailed description, which, taken in conjunction with the annexed drawings discloses preferred embodiments of the present invention.

BRIEF DESCRIPTION OF THE DRAWINGS

Referring to the drawings which form a part of this original disclosure:

FIG. 1 is a side elevational view in section of an electrical switch according to a first embodiment of the present invention;

FIG. 2 is a side elevational view in section of an electrical switch according to a second embodiment of the present invention;

FIG. 3 is an end elevational view of the switch operator body according to each embodiment of the present invention;

FIG. 4 is a side elevational view in section of the operator body taken along lines 4—4 of FIG. 3;

FIG. 5 is an end elevational view of the switch operator member of each embodiment of the present invention;

FIG. 6 is a side elevational view in section of the switch operator member taken along lines 6—6 of FIG. 5;

DETAILED DESCRIPTION OF THE INVENTION

Figure 8:
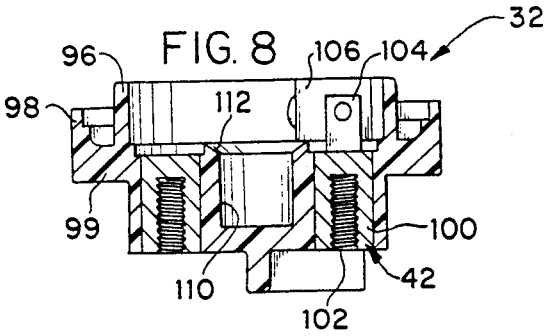
FIG. 8 is front elevational view in section of the terminal base taken along lines 8—8 of FIG. 7.

Referring initially to FIG. 1, the electrical switch 20 of the present invention basically comprises to assemblies, a push button actuator assembly 22 and an operator assembly 24. These two assemblies are essentially separated by a partition wall 26 in which the switch is mounted.

The electrical switch 21 of the second embodiment illustrated in FIG. 2 comprises selector switch actuator assembly 23 coupled to the same operator assembly as in the embodiment of FIG. 1. Actuator assembly 23 and operator assembly 24 are mounted on opposite sides of partition wall 26. The operator assembly is designed to be capable of mating and operating with different actuator assemblies without modification of the operator assembly.

The common operator assembly 24 of switches 20 and 21 comprises a non-metallic terminal base 32, a non-metallic operator body 34 attached to terminal base 34 to define a contact chamber 36 therebetween, a non-metallic operator member 38 inside contact chamber 36, and a contact operator shaft 40 coupled to the operator member for relative movement. Stationary contacts 42 are mounted in terminal base 32. Movable contacts 44 are mounted on operator shaft 38 for simultaneous movement therewith. The downward movement, as illustrated in FIG. 1, of operator member 38 relative to operator body 34 causes rotational movement of operator shaft 40, and thereby movement of movable contacts 44 between different angular positions engaging and disengaging stationary contacts 42.

Operator body 34, illustrated in detail in FIGS. 3 and 4 is a one piece unitary member of molded plastic, particularly injection molded thermoplastic polyester. The operator body has a radial wall 46. A tubular outer wall 48 extends from radial wall 46 to a free end 50 which is ultimately connected to terminal base 32. Outer wall 48 is generally in the form of a right circular cylinder. A cylindrical wall 52 also extends from radial wall 46, but in a direction opposite to outer wall 46. Cylindrical wall 52 has an external thread 54 interrupted by a groove 55 extending along the entire length of cylindrical wall 52 but only a part of the peripheral extent of cylindrical wall 52. A central passageway 56 extends through cylindrical wall 52 and radial wall 46, and is coaxial to the longitudinal axis of operator body 34.

Outer wall 48 has an annular flange 58 extending radially outwardly from the outer surface of outer wall 48 adjacent to but spaced from free end 50. The internal surface of outer wall 48 has an axially extending groove 60 which extends for only a part of the axial length of and peripheral extent of the outer wall.

Inside of outer wall 48, operator body 34 has two inner walls 62 and 64 which are in the shape of right circular cylinders. The inner walls extend axially from radial wall 46 and are concentric to outer wall 48. Inner walls 62 and 64 are spaced in a radial direction of the operator body from each other and from outer wall 46 by annular spaces 66 and 68, respectively. The free ends of inner walls 62 and 64 are spaced from outer wall free end 50. Inner walls 62 and 64 are substantially equal in length and have thicknesses in the radial direction which are essentially equal.

Referring now to FIGS. 5 and 6, operator member 38 comprises a unitary, one piece, injected molded member of thermoplastic material, particularly polyester. The operator member comprises a radially extending outer wall 70 and a hollow axial portion 72 extending from an upper surface of the bottom wall. Axial portion 72 has an outer surface in the shape of a right circular cylinder. Bottom wall 70 has a depending U-shaped ridge 74 which extends about a central bore 76.

Operator member axial portion 72 includes a central radially extending wall 78 which divides the interior of axial portion 72 into an upper axial bore 80 and a lower axial bore 82. Upper axial bore 80 has four radially inwardly extending projections 84 adjacent center wall 78 and spaced from the open end of the upper axial bore. Lower axial bore 82 has two, diametrically oppositely positioned helical recesses 86. Recesses 86 open in a radial direction into bore 82 and open in an axial direction within the area of bottom wall 70 defined by ridge 74.

Concentric to axial portion 72, operator member 38 has two tubular flanges 88 and 90 in the form of right circular cylinders. The tubular flanges are equal in thickness in a radial direction and are equal in length in an axial direction of operator member 38. The flanges are radially spaced from each other by a radial annular space 92. Tubular flange 90 is spaced from axial portion 72 by a radial annular space 94. Spaces 92 and 94 are of equal width in a radial direction of the operator member and are also equal in width to the radial width of inner wall 62 and 64 of operator body 34.

In the assembled device illustrated in FIG. 1, tubular flanges 88 and 90 are received within operator body spaces 66 and 68 and axial portion 72 is received within central passageway 56 with adequate clearance to permit relative axial sliding of the operator body and the operator member. The axial lengths of flanges 88 and 90, walls 62 and 64 and helical grooves 86 are selected such that flanges 88 and 90 and walls 62 and 64 remain overlapped in all operative positions of the operator body and the operator member.

Figure 7:
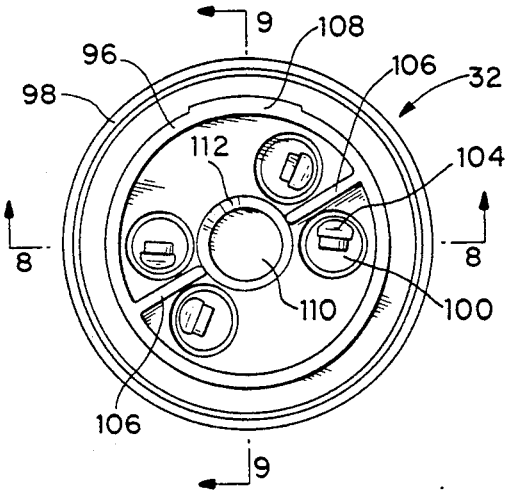
FIG. 7 is a top plan view of a switch terminal base for each embodiment of the present invention.
Figure 9:
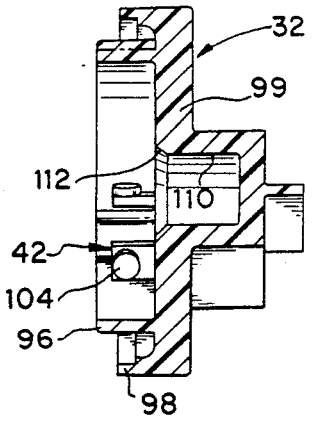
FIG. 9 is a side elevational view in section of the terminal base taken along line 9—9 of FIG. 7.

Referring now to FIGS. 7-9, terminal base 32 is injected molded of thermoplastic material, particularly polyester. The terminal base has an inner peripheral rim 96 and an outer peripheral rim 98 which are generally in the form of right circular cylinders. Stationary contacts 42 are molded into the body 99 of the terminal base. The stationary contacts include a lower section 100 with an internally threaded bore 102 and an upper section 104 extending from the terminal base body but within the periphery of inner rim 96. Threaded bores 102 permit the coupling of electrical wiring to the switch. Upper sections 104 provide the electrical contacts within the switch which directly engage or are disengaged from the movable contacts 44.

In the illustrated embodiment, as best shown in FIG. 7, four stationary contacts 100 are provided. Adjacent pairs of contacts 100 are separated within inner rim 96 by walls 106 which extend radially inwardly from inner rim 96.

The outer surface of inner rim 96 has a radial projection 108. The peripheral or angular extent and radial extension of projection 108 from inner rim 96 is equal to the corresponding dimensions of groove 60 in operator body 34.

When terminal base 32 is attached to operator body 34, as illustrated in FIG. 1, projection 108 is received within the lower portion of groove 60 to accurately and positively locate or key the terminal base and the operator body in the correct rotational position. Additionally, the end portion of outer wall 48 adjacent free end 50 is received between and engages rims 96 and 98, with free end 50 engaging body 99 and annular flange 58 abutting the top end of rim 98.

The terminal base has a blind bore 110 opening upwardly and oriented coaxially to rims 96 and 98. The upper end of blind bore 110 has frustroconical section 112 which tapers in a downward direction, as illustrated in FIGS. 1, 2 and 8, toward the closed end of the blind bore.

Figure 10:
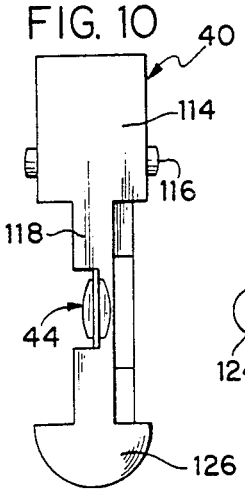
FIG. 10 is a front elevational view of an operator shaft for each embodiment of the present invention.
Figure 11:
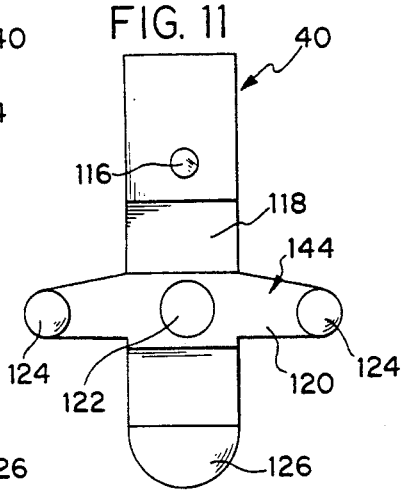
FIG. 11 is a side elevational view of the switch operator shaft of FIG. 10.

The details of operator shaft 40 are best illustrated in FIGS. 10 and 11. Operator shaft 40 forms operator means and is generally cylindrical in shape. The upper section 114 has a shape of a right circular cylinder with transverse dimensions adapted to the slidably and rotatably received within lower axial bore 82 of operator member 38. The axial length of upper section 114 is substantially less than the axial length of bore 82. Adjacent the lower end of upper section 114, two radially extending, cylindrical lugs 116 extend in diametrically opposite directions. The lugs have axial and transverse dimensions adapted to operate with helical recesses 86 in operator member 38. When shaft upper section 114 moves within bore 82, the engagement of helical recesses 86 and lugs 116 will cause the shaft to rotate in one direction or other depending on the direction of the relative axial movement between shaft 40 and operator member 38. Only the shaft rotates since operator member 38 is restrained from rotation in operator body, as will be explained hereinafter. The engagement of lugs 116 and helical recesses 86 also properly locates the shaft in a rotational position relative the remaining structure of the operator assembly.

The middle section 118 of shaft 40 has portions of reduced diameter providing flat surfaces for attachment of the movable contacts 44. Movable contacts 44 comprises a horizontal, metallic beam 120 which is attached to shaft middle section 118 by a rivet 122. The ends of contact beam 120 have contact members 124.

The lower section 126 of operator shaft 40 comprises a hemispherical dome. The hemispherical lower section is received within blind bore 110 of terminal base 32 with adequate play permitting rotation of the shaft relative to the terminal base. The frustroconical section 112 and the lateral walls of blind bore 110 accurately locate the shaft relative to the terminal base to position the movable contacts properly relative to stationary contacts 42 in directions transverse to shaft rotation. The hemispherical shape of the lower end of shaft 40 also reduces wear by providing a point contact with the terminal base.

Figure 12:
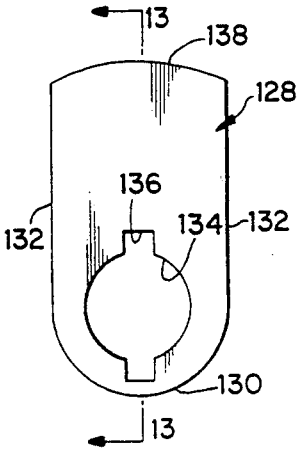
FIG. 12 is a top plan view of the locator for each embodiment of the present invention.
Figure 13:
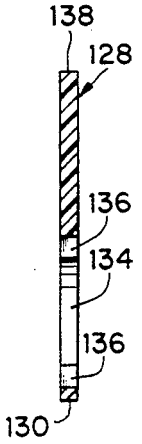
FIG. 13 is a side elevational view in section of the locator taken along line 13—13 of FIG. 12.

A locator 128, illustrated in detail in FIGS. 12 and 13, is secured to bottom wall 70 of operator member 38 by adhesive 129. The attachment of locator 128 to operator member 38 is illustrated in FIGS. 1 and 2. The locator is a generally flat plate with one rounded end 130 and two lateral sides 132 shaped to conform with operator member ridge 74. In assembly, end 130 and sides 132 abut and engage ridge 74. Adjacent end 130, a circular opening extends through the locator and includes two radial extensions 136. Opening 134 and extensions 136 conform in shape, size and location to the opening of bore 76 and the axial openings of helical recesses 86 on the bottom end surface of bottom wall 70. The other end 138 of the locator conforms in size and shape to groove 60 in operator body 34.

When the locator is attached to operator member 38 and the operator member is mounted within operator body 34, end 138 is slidably received within groove 60. The engagement of locator end 138 in groove 60 locates the operator member in its proper rotational position within the operator body and prevents relative rotation between the operator member and the operator body, while permitting relative axial sliding movement between the operator body and the operator member.

As illustrated in FIGS. 1 and 2, a coil compression spring 140 is located within operator member lower axial bore 82 between operator member wall 78 and the upper end of shaft 40. Spring 140 is formed of metal, and serves to bias operator member 38 upwardly within the operator body 34 and shaft 40 against terminal base 32.

Referring now to FIG. 1, actuator assembly 22 comprises a shroud of 142, a gasket 144, gasket retainer 146 and a push button 148 of plastic material. Shroud 142 is a generally cylindrical member having an internal thread 150 at one end and an internal annular flange 152 adjacent its opposite end.

Gasket retainer 146 is also generally cylindrical and has an external thread 154 engaging shroud thread 150 and an internal thread 156 for engaging operator body thread 54 adjacent the lower end of retainer 146 to couple actuator assembly 22 and operator 24. Gasket 144 is resilient and flexible, and has an annular rim 158 trapped between the upper end 160 of retainer 146 and the lower surface of annular flange 152 of shroud 142. The tight engagement threads 150 and 154 secures gasket 144 in place. A color coded circular disk 162 can be fitted within an annular recess located within the center of disk 144.

Push button 148 is generally T-shaped in transverse cross-section. The horizontal member 164 underlies the central portion of gasket 144. The vertical member 166 is hollow, has an internal thread 168 adjacent its upper end and extends through an opening 170 in retainer 146. The push button is slidably received within opening 170, and therefore, is axially movable relative to shroud 142 and retainer 146. The lower end of vertical member 146 is received within upper axial bore 80 of operator member 38. The lower end surface of push button 148 rests on projections 84. Internal thread 168 permits attachment of another actuating knob, upon removal of and in lieu of disk 162 and upon cutting an opening in gasket 144.

The switch is assembled and mounted on partition wall 26 as illustrated in FIG. 1. Actuator assembly 22 and operator assembly 24 are placed on the opposite sides of partition wall 26 such that operator body cylindrical wall 52 extends through the opening in the partition wall. The internal threads 156 of actuator retainer 146 threadly engage operator body wall 52 to couple the actuator and operator assemblies. A projection extending within the partition wall opening from the partition can be received within groove 55 to locate the switch in its proper rotational position. Gaskets 172 are located between the operator body radial wall 46 and the adjacent partition wall surface to seal the opening in the partition wall.

Electrical switch 20 is normally in the condition illustrated in FIG. 1 with movable contacts 44 engaged to one pair of the stationary contacts or disengaged from all stationary contacts. The switch is actuated by the operator applying a downward force, as illustrated in FIG. 1 on disk 162. The downward pressure on disk 162 causes push button 148 to be moved downwardly. Downward movement of push button 148 causes operator member 138 to also move downwardly. As operator member 138 moves downwardly, compressing spring 140, shaft lugs 116 to move within helical grooves 86. Since the operator member is restrained from rotational movement relative to the operator body by the engagement of locator 128 and groove 60, shaft 40 is caused to rotate. Rotation of the shaft can cause movement of movable contacts 44 to engage the other pair of stationary contacts 42 in terminal base 32. When the force is released by the operator from disk 162, the parts will move in an opposite direction and return to their original position under the bias of spring 140.

The flame proof, labyrinth connection between the operator body and the operator member provided by the operator body walls 48, 62 and 64 and the operator member axial portion 72 and flanges 88 and 90 prevent the propagation of any flame generated in chamber 36 from entering hazardous environment 28 or 30 by extinguishing the flame. Even though some hazardous gases or vapors may enter the contact chamber 36, any flame or explosion generated would be maintained relatively small and retained within the sealed contact chamber 36.

Actuator assembly 23 comprises a shroud 174 having internal threads 176 engaging external threads 178 on a selector switch retainer 180. Retainer 180 has internal threads 182 for engaging operator body threads 54. A selector switch knob 184 is mounted within shroud 174 between the upper surface of retainer 180 and the lower surface of an annular flange 186 extending inwardly adjacent the upper end of the shroud. The upper portion of the knob extends outwardly beyond the shroud to facilitate engagement by the operator.

A selector switch shaft 188 is slidably received within the central opening 190 in retainer 180 for axial sliding movement. A compression spring 192 surrounds a portion of shaft 188 and engages an upper horizontal flange 194 of shaft 188 and the upper surface of retainer 180. The spring is housed within a gasket sleeve 196. A cam 198 is fixed to knob 184 by a pin for simultaneous rotation, but is rotatably mounted for relative rotation on the top of shaft 188.

Rotation of knob 184 causes rotation of cam 198. The rotation of cam 198 causes shaft 188 to move downwardly against the bias of spring 192 the downward movement of shaft 192 causes downward movement of operator member 38 within operator body 34. The remainder of the switch operation is as discussed above in connection with the embodiment of FIG. 1. When the knob is rotated in the opposite direction, cam 198 permits the shaft to move upwardly under the bias of spring 192 such that the switch parts can return to their original position. The knob rotation can be set in three positions, providing selective engagement of movable contacts 44 with either pair of stationary contacts 42 or disengagement of the movable contacts from all of the stationary contacts.

The connection between terminal base 32 and operator body 34 is designed for ultrasonic welding at points 200. This ultrasonically welded joint is capable of withstanding internal pressures in excess of 200 pounds per square inch, and provides a hermetic seal at the terminal base-operator body junction.

The only metal parts of the switch are spring 140 and contacts 42 and 44. However, these metal parts are safely isolated from the hazardous environment by the flame-proof, labyrinth connection.

While various embodiments having been chosen to illustrate the invention, it will be understood by those skilled in the art that various changes and modifications can be made therein without departing from the scope of the invention as defined in the appended claims.

What is claimed is:

1. An electrical switch, comprising:

a non-metallic terminal base supporting a plurality of stationary electrical contacts;

a non-metallic operator body having a radial wall and a tubular outer wall extending from said radial wall, said outer wall having a free end coupled to said terminal base and defining a contact chamber therein, said radial wall having a central passageway and at least one tubular inner wall extending from said radial wall toward said terminal base substantially concentrically to said outer wall and said passageway;

a non-metallic operator member having an axial portion slidably received in said passageway between first and second positions and having a radial portion extending from said axial portion with at least one tubular flange extending therefrom substantially concentrically to said axial portion, said tubular flange being slidably received between and overlapping said inner and outer walls of said operator body in both of said first and second positions of said operator member;

operator means, coupled to said operator member, for movement between open and closed positions in response to movement of said operator member between said first and second positions thereof; and movable contacts mounted on said operator means for simultaneous movement therewith between positions engaging and disengaging said stationary contacts on said terminal base.

2. An electrical switch according to claim 1 wherein said inner and outer walls and said tubular flange are cylindrical.

3. An electrical switch according to claim 2 wherein first key means, coupled to said operator body and said operator member, locates said operator body and said operator member in a proper relative rotational position.

4. An electrical switch according to claim 3 wherein said first key means comprises an axial groove on an inside surface of said outer wall and a mating radial projection on said operator member extending into and axially slidable in said groove.

5. An electrical switch according to claim 2 wherein second key means, coupled to said operator body and said terminal base, locates said operator body and terminal base in a proper relative rotational position.

6. An electrical switch according to claim 5 wherein said second key means comprises an axial groove on an inside surface of said outer wall and a mating radial projection on said terminal base extending into said groove.

7. An electrical switch according to claim 1 wherein said operator means comprises a shaft rotatably coupled to said operator member and said terminal base; and said movable contacts extend radially from said shaft.

8. An electrical switch according to claim 7 wherein one end of said shaft adjacent to and engaging said terminal base is generally semi-spherical.

9. An electrical switch according to claim 8 wherein said terminal base comprises a cavity receiving said one end of said shaft with sufficient clearances to align said movable and stationary contacts.

10. An electrical switch according to claim 7 wherein said operator member comprises a central bore receiving a portion of said shaft, said bore having at least one, radially inwardly opening helical recess;

said shaft comprises a radial extending lug received in said helical recess such that relative axial movement of said shaft in said bore causes said shaft to rotate.

11. An electrical switch according to claim 10 wherein a spring is mounted between a closed end of said bore and an adjacent end of said shaft.

12. An electrical switch according to claim 9 wherein first key means, coupled to said operator body and said operator member, maintains said operator body and said operator member in a proper relative rotational position but permits relative axial movement therebetween.

13. An electrical switch according to claim 1 wherein said terminal base, operator body and operator means, except for said contacts, are formed of thermoplastic polyester.

14. An electrical switch according to claim 1 wherein said operator body and said terminal base are joined by ultrasonic welding.

15. An electrical switch according to claim 1 wherein said stationary contacts are molded in said terminal base.

16. An electrical switch according to claim 1 wherein said operator body comprises coupling means on one end thereof remote from said terminal base for receiving different actuating means.

17. An electrical switch according to claim 16 wherein said coupling means comprises external threads.

18. An electrical switch according to claim 1 wherein said operator body comprises two tubular inner walls being substantially right circular cylinders, having radial thicknesses and being radially spaced by distances from each other and said outer wall;

said operator member comprises two tubular flanges being substantially right circular cylinders, having radial thicknesses and spacings substantially equal to said distances and said thickness, respectively, of said operator body.

19. An electrical switch according to claim 1 wherein said operator means and said movable contacts are mounted for rotational movement.

* * * * *